US005769133A

United States Patent [19]

Dyer et al.

[11] Patent Number: 5,769,133

[45] Date of Patent: Jun. 23, 1998

[54] POWER ACTUATED HANDHELD TENSIONING AND CUTOFF TOOL

[75] Inventors: Edward Paul Dyer, Germantown; William Karl Lueschen, Cedarburg, both of Wis.

[73] Assignee: Tyton-Hellermann Corp., Milwaukee, Wis.

[21] Appl. No.: 841,935

[22] Filed: Apr. 8, 1997

[51] Int. Cl.[6] ..... B21F 9/00

[52] U.S. Cl. ..... 140/123.6; 140/93.2

[58] Field of Search ..... 140/93 A, 93.2, 140/123.6

[56] References Cited

U.S. PATENT DOCUMENTS 3,118,473 1/1964 Bell ..... 140/123.6
3,254,680 6/1966 Caveney et al. ..... 140/123.6
3,438,406 4/1969 Rozmus ..... 140/123.6
3,865,156 2/1975 Moody et al. ..... 140/123.6

*Primary Examiner*—Lowell A. Larson
*Attorney, Agent, or Firm*—Ryan, Maki, Mann & Hohenfeldt

[57] ABSTRACT

A power assisted system for tensioning and cutting off flexible cable ties includes a handheld unit coupled to a remote power unit by a flexible pull-cable. A trigger on the handheld unit signals the remote power unit to pull the pull-cable and thereby actuate the tool. A tie gripping and tensioning mechanism is provided in the handheld unit as is a cutoff mechanism that automatically cuts off the cable tie tail when the desired tension is achieved. Because operating power is provided by the remote unit, the handheld unit can be made small and lightweight without sacrificing power. Control signals are communicated from the handheld unit to the remote unit through wires carried alongside the pull-cable within a common sheath. Alternatively, the control signals can be communicated through the pull-cable itself.

52 Claims, 11 Drawing Sheets

24
162
164
166
176
8
8
174
168
170
178
150
158
156
154
172
168
152
180
160
176
166
162
164

168
166
162
150
164

POWER ACTUATED HANDHELD TENSIONING AND CUTOFF TOOL

BACKGROUND OF THE INVENTION

This invention relates to tools for installing cable ties and, more particularly, to handheld tools that apply tension to such ties and cut off the excess portion of such ties while holding the tie under tension. More particularly, this invention relates to such handheld tools that rely on external power, rather than muscle power, for operation.

Flexible cable ties are well known items. Such ties are used to secure wires, cables, tubing and similar items into tight, neat bundles. Typically, flexible cable ties include a head portion and a tie tail portion extending from the head. In use, the tie tail is looped around the items to be secured and then inserted through the head. A locking or ratcheting mechanism in the head holds the tie tail in the head and secures the tie around the bundle. Preferably, the tie tail is pulled through the head under tension to draw the items to be secured into a tight bundle. Thereafter, the excess portion of the tie tail is clipped off near the head.

Although it is possible to install a flexible cable tie by hand, hand installation is impractical in large scale manufacturing operations where each individual worker might be expected to install hundreds or thousands of ties in a single day. Accordingly, a variety of tools have been developed to enable workers to install flexible cable ties with speed, uniformity and economy. Generally, such tools function to grip the tie tail portion of the tie after the tie has been looped around the items to be bundled. The tool pulls the tie tail until a predetermined desired tension is achieved after which the tool cuts off the excess portion of the tie tail closely adjacent the head. Such tools greatly simplify the task of properly installing cable ties.

Although fully automatic machines have been developed for installing flexible cable ties, most flexible cable ties are installed by human workers using handheld tools. In one well known form of handheld tool, the tool comprises a pistol or gun-like device having a movable trigger or lever that is squeezed by the operator to pull on the tie tail and thereby tension the tie. The operator continues squeezing the trigger until a predetermined tension is achieved after which a cutting blade adjacent the nose of the tool snaps upwardly to clip off the excess portion of the tie tail. A knob at the rear of the tool allows the worker to adjust or set the tension at which cutoff occurs. Examples of such manually operated handheld tools are shown in the inventors' U.S. Pat. Nos. 4,997,011, issued Mar. 5, 1991, and 4,793,385 issued Dec. 27, 1998, commonly owned by the assignee hereof.

Although manually operated handheld tools greatly simplify the installation of cable ties, efforts have been made to obtain further improvement by adding external power to the tool. External power reduces the physical labor expected of the worker, thereby improving efficiency and speeding operation. In addition, adding external power might help avoid claims made for repetitive stress injuries and similar conditions.

Prior attempts to add external power to handheld cable tie tools have focused on incorporating electric motors, solenoids or pneumatic cylinders into the handheld tool itself. Although effective in providing powered tool operation, the extra structure thus added to the handheld tools increased tool weight and bulk thereby making the tools somewhat inconvenient and difficult to use, particularly for long periods of time. Similarly, the practical size and weight limitations imposed by confining the actuating structures within the handheld tools limited the maximum power that was obtainable and thereby limited the maximum tension and operating speed that could be obtained with the tools.

SUMMARY OF THE INVENTION

The invention provides a power assisted tensioning and cut-off tool system comprising a remote power unit, a handheld unit operable to tension a cable tie and to cutoff the excess portion of the cable tie when a predetermined tension has been achieved in the cable tie, a power transfer member interconnecting the remote power unit with the handheld unit for transferring actuating power from the remote power unit to the handheld unit and a user actuatable trigger for actuating the remote power unit to transfer actuating power to the handheld unit.

The invention also provides a power actuatable handheld tool for tensioning a cable tie and for cutting off the tie tail portion of the tensioned cable tie. The tool includes a pistol-shaped housing having a handle portion and a barrel portion. A trigger link within the handle portion is movable between an initial position and a final position. A tie gripping and tensioning mechanism in the barrel portion is coupled to the trigger link for gripping the tie tail of the cable tie and pulling the tie tail in response to movement of the trigger link from the initial position to the final position. A cutoff mechanism is coupled to the trigger link for severing the tie tail when tension in the tie tail reaches a predetermined threshold, and structure is provided for connecting the trigger link to an external source of actuating power.

The invention also provides a remote power unit for supplying actuating power to a handheld tool operable to tension a cable tie and to sever the tie tail of the tensioned cable tie. The remote power unit includes a linear actuator, a pull-cable coupled to the linear actuator and a control system responsive to first and second control signals developed by the handheld tool. The control system operates to actuate the linear actuator to pull the pull-cable from an initial position to a final position in response to receipt of the first control signal and to return the pull-cable from the final position to the initial position in response to receipt of the second control signal.

The invention also provides a power actuatable handheld tool for tensioning a cable tie and for cutting off the tie tail portion of the tensioned cable tie. The power actuatable handheld tool includes a pistol-shaped housing having a handle portion and a barrel portion and further having a trigger link within the handle portion movable between an initial position and a final position. A tie gripping and tensioning mechanism is provided in the barrel portion and is coupled to the trigger link for gripping the tie tail of the cable tie and pulling the tie tail in response to movement of the trigger link from the initial position to the final position. A cutoff mechanism is coupled to the trigger link for severing the tie tail when tension in the tie tail reaches a predetermined threshold. A pull-cable is connected to the trigger link and is operable to pull the trigger link from the initial position to the final position. A return mechanism is provided for returning the trigger link from the final position to the initial position when the pull-cable ceases pulling the trigger link toward the final position.

It is an object of the invention to provide a new and improved handheld tool for tensioning and cutting off flexible cable ties.

It is a further object of the invention to provide a new and improved handheld tool for tensioning and cutting off flexible cable ties that is compact, lightweight and easy to use.

It is a further object of the invention to provide a new and improved handheld tool for tensioning and cutting off flexible cable ties that is operated using an external source of power.

It is a further object of the invention to provide a new and improved handheld tool for tensioning and cutting off flexible cable ties that is capable of achieving high cable tie tension using a small, lightweight tool.

It is a further object of the invention to provide a new and improved handheld tool for tensioning and cutting off flexible cable ties that avoids operator fatigue and/or repetitive stress conditions.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DESCRIPTION OF THE PREFERRED EMBODIMENT

THE TENSIONING AND CUTOFF TOOL SYSTEM

Figure 1:
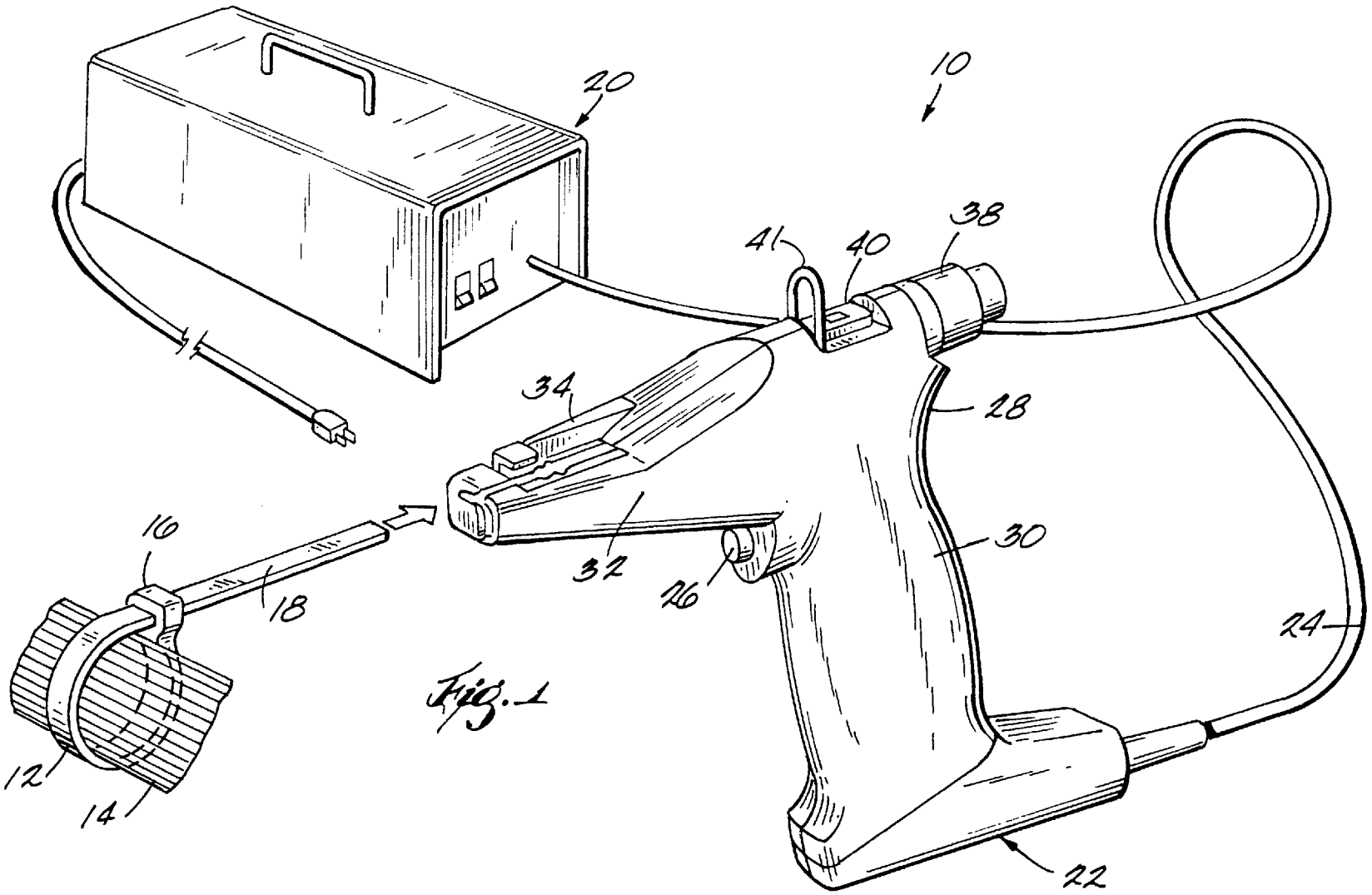
FIG. 1 is a perspective view of a power aassisted tensioning and cutoff tool system embodying various features of the invention and including a handheld unit, a remote power unit and a power transfer cable interconnecting the two..

A power assisted tensioning and cutoff tool system 10 embodying various features of the invention is shown in FIG. 1. The system 10 is typically used to install flexible cable ties 12 around wire or cable bundles 14. As illustrated, the cable tie 12 includes a head portion 16 and a tie tail portion 18. The system 10 grips the tie tail portion 18 of the cable tie 12 and pulls it through the head 16 until a predetermined tension is achieved. The system 10 then automatically cuts off the excess tail portion 18 closely adjacent the head 16.

Various types of cable tie installation tools have previously been developed. Such tools have included handheld tools that rely on muscle power for operation. Typically, such tools require the operator to squeeze a trigger or lever in order to tension the tie and cut off the excess tail portion. Although effective in facilitating the installation of cable ties, such tools can become tiring to use, particularly in large scale manufacturing operations where many ties are installed over the course of several hours. Other tools have used externally supplied actuating power rather than hand power. In such tools, an actuator, such as a motor or pneumatic cylinder, was incorporated into the handheld tool. This resulted in a handheld tool that was heavy, bulky and difficult to use over long periods of time.

The power assisted tensioning and cutoff system 10 of the present invention eliminates the need for the operator to supply the actuating power without resulting in a tool that is large, heavy and bulky. To this end, the power assisted tensioning and cutoff system 10 includes a remote power unit 20, a handheld unit 22 and a power transfer member for transferring actuating power from the remote power unit 20 to the handheld unit 22. In the illustrated embodiment, the power transfer member comprises a flexible cable 24 interconnecting the remote power unit 20 with the handheld unit 22. A user actuatable trigger 26 on the handheld unit 22 actuates the remote power unit 20 to transfer actuating power from the remote power unit 20 to the handheld unit 22 via the cable 24.

The handheld unit 22 includes a generally gun or pistol shaped housing 28 having a handle or grip portion 30 and a barrel portion 32. The cable 24 joins to the housing at the rear lower end of the grip portion 30. The trigger 26 is located at the upper forward portion of the grip 30 just under the barrel portion 32 where it falls naturally under the index finger of the operator.

The cable tie 12 is tensioned by means of a tie gripping and tensioning mechanism 34 located at the forward end of the barrel portion 32 of the handheld unit 22. The tie gripping and tensioning mechanism 34 grips the tail portion 18 of the tie 12 an pulls it when the trigger 26 is depressed. As long as the trigger 26 is depressed, the gripping and tensioning mechanism continues pulling the tie tail 18 until a predetermined tension is reached. When the predetermined tension is reached, a cutoff mechanism 36 (FIG. 2), also located at the forward end of the barrel portion 32, cuts off the tie tail 18 closely adjacent the head 16. The predetermined tension is set or adjusted by means of an adjustment knob 38 at the rear of the handheld unit 22. The relative tension thus set by the knob 38 is indicated by means of an indicator visible through a window 40 at the top of the handheld unit 22. A hanging hook 41 is provided for hanging the handheld unit from a belt or other support.

The remote power unit 20 comprises a self-contained, portable unit that can be connected to a source of power such as readily available 60 Hz., 110 VAC current. The remote power unit 20 contains the mechanical and electrical assemblies that provide the power for tensioning and cutting off the cable tie. Because the actuating power for actuating the handheld unit 22 is developed by the remote power unit 20 and delivered to the handheld unit 22 through the flexible, elongate cable 24, the remote unit 20 can be located away from the area in which the cable ties 12 are to be installed and where the handheld unit 22 is actually to be used. Furthermore, because the remote power unit 20 is remote from the handheld unit 22, the remote unit 20 can be made relatively large and heavy without adversely affecting the lightweight, compact nature of the handheld unit 22. Nevertheless, because size and weight constraints are less important in the case of the remote unit 20 than in the case of the handheld unit 22, considerable operating power can be delivered to the handheld unit 22 without increasing the size and weight of the handheld unit 22.

THE HANDHELD UNIT

The Tie Gripping and Tensioning Mechanism

The construction and operation of the handheld unit 22 can best be understood by reference to FIGS. 2–6. As illustrated, the tie gripping and tensioning mechanism 34 is internally mounted within the barrel portion 32 and includes a pair of spaced, parallel pawl links 42 mounted for horizontal, linear reciprocating movement relative to the housing 28. The forwardmost end of the handheld unit 22 carries a metallic nose piece 44 having a blunt, substantially vertical planar face 46 adapted to butt up against the head 16 of the cable tie 12 when the tie is tensioned. The nose piece 44 further includes an upper horizontal portion 48 that, in cooperation with the face 46, defines a slot 50 for receiving the tie tail 18 of the cable tie 12. As best seen in FIG. 1, the slot 50 is open toward the left hand side of the handheld unit 22 so that the tie tail 18 can be inserted into the handheld unit 22 from the side. A nose guide block 52 positioned immediately behind the nose piece 44 defines a lower surface for supporting the underside of the tie tail 18.

The tie tail 18 is gripped by means of a tie gripping pawl 54 carried at the forwardmost ends of the pawl links 42. The gripping pawl 54 is pivotally attached to the pawl links 42 and is upwardly pivotable toward a backing plate 56, also carried at the ends of the pawl links 42. Preferably, the gripping pawl 54 is rotatably biased toward the backing plate by means of a torsion spring 55 so that a cable tie tail inserted therebetween will be engaged by and between those elements.

Figures 2, 5:
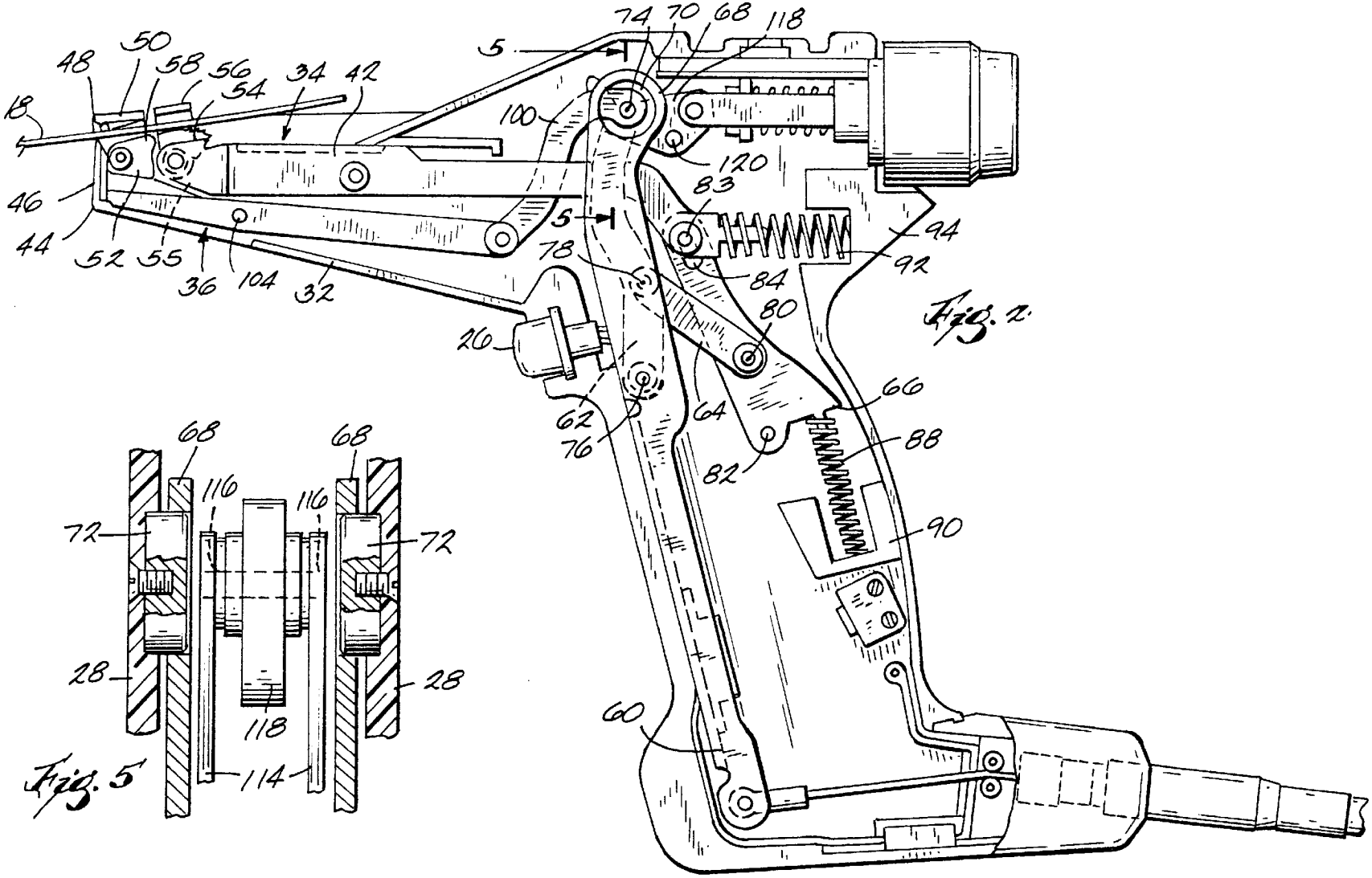
FIG. 2 is a cutaway sideview of the handheld unit showing the unit in an initial position before actuation.
FIG. 5 is a cross-sectional view of the handheld unit taken along line 5—5 in FIG. 2 useful in understanding the mounting arrangement of a trigger link in the handheld unit.

When the pawl links 42 reciprocate toward the right as viewed in FIG. 2, the gripping pawl 54 engages the tie tail 18 still harder, thereby pulling the tie tail 18 along with the pawl links 42. A protrusion 58 on the nose guide block 52 engages the gripping pawl 54 when the pawl links are at the leftmost position as viewed in FIG. 2 to pivot the gripping pawl 54 away from the backing plate 56 and thereby facilitate insertion of the tie tail 18 into the handheld unit 22. It will be appreciated that, as the pawl links 42 move to the right as viewed in FIG. 2, the gripping pawl 54 grips the tie tail 18 to pull the tie tail 18 and thereby tension the tie.

As the pawl links 42 move to the left as viewed in FIG. 2, the gripping pawl 54 releases its grip on the tie tail 18, thereby permitting the pawl links 42 to return to their initial position without simultaneously moving the tie tail 18.

Referring further to FIGS. 2–6, the pawl links 42 are reciprocated within the housing 28 by means of an actuating structure including a trigger link 60, a pair of actuating links 62, a pair of short links 64 and a handle link 66.

The trigger link 60 comprises an elongate, rigid member that extends within, and roughly along the entire length of, the grip 30 adjacent the leading or forward side thereof. The upper end of the trigger link extends well above the grip 30 and terminates within the barrel portion 32 adjacent the upper end thereof, substantially between its ends. The trigger link 60 is of substantially rectangular U-shaped section adjacent its lower end and includes two substantially parallel, spaced arms 68 at its upper end. Each of the arms 68 includes a circular aperture 70. A pair of circular trigger bearings 72, dimensioned to be closely received in the apertures 70, are mounted to the interior of the housing as best seen in FIG. 5 and serve to pivotally mount the trigger link 60 within the housing 28 for movement around a substantially horizontal pivot axis 74. When thus mounted, the trigger link 60 is movable from the forward or initial position shown in FIG. 2 to the rearward or final position shown in FIGS. 3 and 4.

Each actuating link 62 comprises a rigid, elongate member of shorter length than the trigger link 60. Each actuating link 62 extends within the confines of the trigger link 60 substantially alongside the arms 68 thereof. The lower ends of the actuating links are pivotally joined to the trigger link 60 for pivoting movement around a horizontal pivot axis 76.

The short links 64 comprise rigid, elongate substantially parallel members that are pivotally joined at their forward ends to the actuating links 62 and at their rear ends to the handle link 66. Each short link 64 joins the adjacent actuating link 62 between the ends thereof for pivoting movement around a substantially horizontal pivot axis 78. Each short link 64 also joins the handle link 66 for pivoting movement around a substantially horizontal pivot axis 80.

The handle link 66 comprises a single, rigid, elongate plate-like member having a lower end pivotally mounted to the grip portion 30 of the housing 28 for pivoting movement around a substantially horizontal pivot axis 82. The upper end of the handle link 66 extends upwardly and forwardly toward the rear ends of the pawl links 42. A pivot pin 83 extending between the rear ends of the pawl links 42 and through a slot 84 in the handle link 66 pivotally joins the upper end of the handle link 66 to the pawl links 42 for pivoting movement around a substantially horizontal pivot axis 86.

A lower return spring 88 confined between the handle link and a support ledge 90 formed in the interior of the grip portion 30 of the housing 28 biases the handle link 66 for rotation around the pivot axis 82 in a counterclockwise direction as viewed in FIGS. 2–6. An upper return spring 92 confined between the rear interior wall 94 of the barrel portion 32 of the housing 28 and the rear ends of the pawl links 42 biases the pawl links for forward movement relative to the housing 28. Together, the upper return spring 92 and the lower return spring 88 bias the trigger link 60 and the pawl links 42 to the forward or initial positions shown in FIG. 2.

The Cutoff Mechanism

The cutoff mechanism 36 comprises a sharpened blade 96, a blade link 98 and a cutoff link 100. The blade 96 is located at the front of the barrel portion 32 immediately behind the nose piece 44. The blade 96 is confined between a pair of vertical channels 102 defined between the nose piece 44 and the housing 28 which permit the blade 96 to reciprocate vertically behind the nose piece 44. When the blade 96 is reciprocated upwardly, it cuts off the tie tail 18 immediately behind the nose piece 44 and closely adjacent the tie head 16.

The blade 96 is reciprocated vertically by means of the blade link 98. The blade link comprises an elongate, rigid lever that extends along the length of the barrel portion 32 below the pawl links 42. The blade link 98 is pivotally mounted to the housing 28 for pivoting movement around a substantially horizontal pivot axis 104. The forwardmost end of the blade link 98 tapers and terminates in a tab 106 (FIG. 6) that is received in a complementary slot 108 formed in the blade 96. As the blade link 98 pivots around the axis 104, the blade 96 is moved up or down.

The rear end of the blade link 98 is pivotally joined to one end of the cutoff link 100 for pivoting movement around a substantially horizontal pivot axis 110. The cutoff link 100 comprises a rigid, elongate member having a first pair of laterally spaced tabs or ears 112 at its lower end and a second pair of laterally spaced tabs or ears 114 at its upper end. The lower ears 112 straddle the rear end of the blade link 98 to establish the pivotal connection thereto. The cutoff link 100 extends upwardly and rearwardly away from the blade link 98 so that the upper ears 114 are concentrically aligned with the upper ends of the actuating links 62 and the pivot axis 74.

As best seen in FIG. 5, the upper ends of the actuating links 62 and the upper ears 114 of the cutoff link 100 are pinned together by a pivot pin 116 extending therethrough. The pivot pin 116 ordinarily rests in a notch formed in a cutoff cam 118 that is pivotally mounted in the housing 28 for pivoting movement around a substantially horizontal pivot axis 120. The cutoff cam 118 is preferably formed of an integral U-shaped piece of durable metal having a ramped forward end 122 ahead of the notch.

A tension control mechanism 124 pivotally connected to the rear of the cutoff cam biases the cam for rotation around the pivot axis 120 in the clockwise direction as viewed in FIGS. 2–6. Accordingly, the cutoff cam 118 ordinarily assumes the rotational position shown in FIGS. 2 and 3. In this position, the cutoff cam 118 keeps the pivot pin 116 concentrically aligned with the pivot axis 74 established by the trigger link 60 and the trigger bearings 72. With the pivot pin 116 so located, the cutoff link 100 pulls the rear end of the blade link 98 upwardly. This causes the blade link 98 to pivot around the pivot axis 104 in the counterclockwise direction as viewed in FIGS. 2–6, thereby lowering the blade 96. If the cutoff cam 118 is permitted to rotate around the pivot axis 120 to the position shown in FIG. 4, the pivot pin 116 is able to slide forwardly out of the notch in the cutoff cam 118. This causes the cutoff link 100 to push the rear end of the blade link 98 down. This, in turn, pivots the blade link 98 in the clockwise direction as viewed in FIGS. 2–6, thereby raising the blade 96. The tie tail 18 is snipped off as the blade 96 is raised.

The Tension Control Mechanism

The tension control mechanism 124 functions to provide a controlled tension to the rear of the cutoff cam 118. This, in turn, determines the point at which the cutoff cam 118 pivots to actuate the cutoff mechanism 36 and thereby cutoff the tie tail 18.

Figure 6:
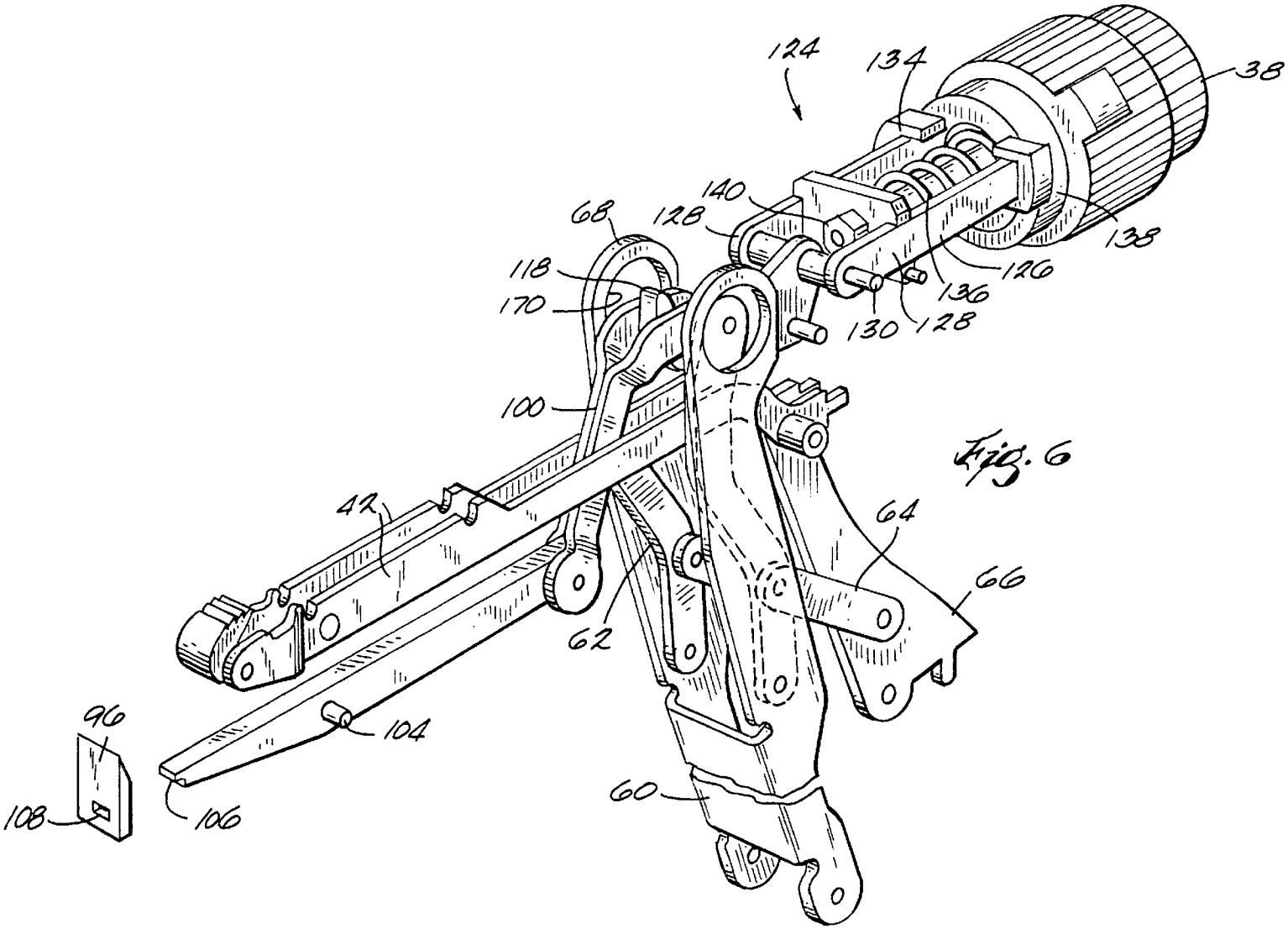
FIG. 6 is a fragmentary perspective view of a tensioning and cutoff subassembly incorporated in the handheld unit and useful in understanding the operation thereof.

Referring principally to FIG. 6, the tension control mechanism 124 includes a U-bracket 126 positioned horizontally, and slidably movable, within the housing 28 at the rear of the barrel portion 32. The forward ends 128 of the U-bracket 126 are pivotally coupled to the rear end of the cutoff cam 118 by means of a tension pin 130 extending through the forward ends 128 of the U-bracket 126 and through an elongated slot 132 formed in the cutoff cam 118. The rearward end 134 of the U-bracket 126 is biased toward the rear of the housing by means of a tension spring 136. The tension spring 136 is confined between a fixed cam 138 and a tension nut 140 that is slidably movable along the arms of the U-bracket 126. A threaded tension rod coupled to the tension adjustment knob 38 threadedly engages the tension nut 140. As the adjustment knob 38 is turned, the threaded rod either draws the tension nut 140 either closer to the fixed cam 138 or drives the tension nut 140 farther from the fixed cam depending upon the direction in which the knob 38 is turned. Accordingly, the tension applied by the U-bracket 126 to the cutoff cam 118 is increased as the knob 38 is turned so as to compress the tension spring 136 and is decreased as the knob 38 is turned to decompress the tension spring 136.

Preferably, the U-bracket is coupled to the indicator through a linkage so that the indicator moves under the window 40 as the tension is adjusted. Similarly, the knob 38 is preferably provided with a "quick adjust" feature of known construction that enables the tension to be set quickly and conveniently to "Low," "Medium" and "High" tension settings. Various forms of such mechanisms are shown, for example, in the inventors' U.S. Pat. Nos. 4,997,011 and 4,793,385, the specifications of which are incorporated by reference herein.

Handheld Unit Operation

Figures 3, 7B:
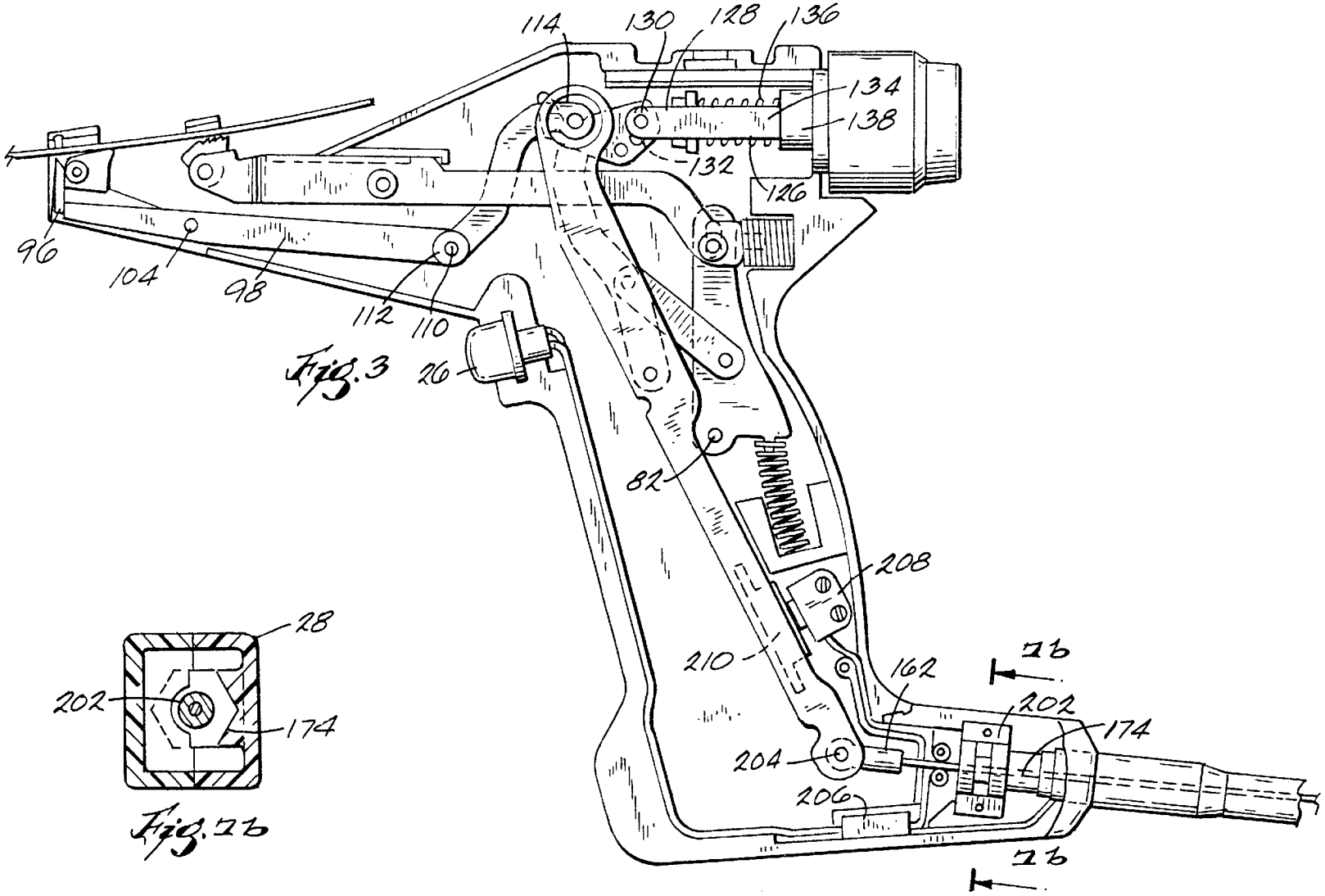
FIG. 3 is a cutaway side view similar to FIG. 2 showing the handheld unit after tension is applied to a cable tie but before the tie is cutoff.
FIG. 7*b* is a cross-sectional view of the flexible cable shown in FIG. 7*a* taken along line 7*b*—7*b* in FIG. 3.
Figure 4:
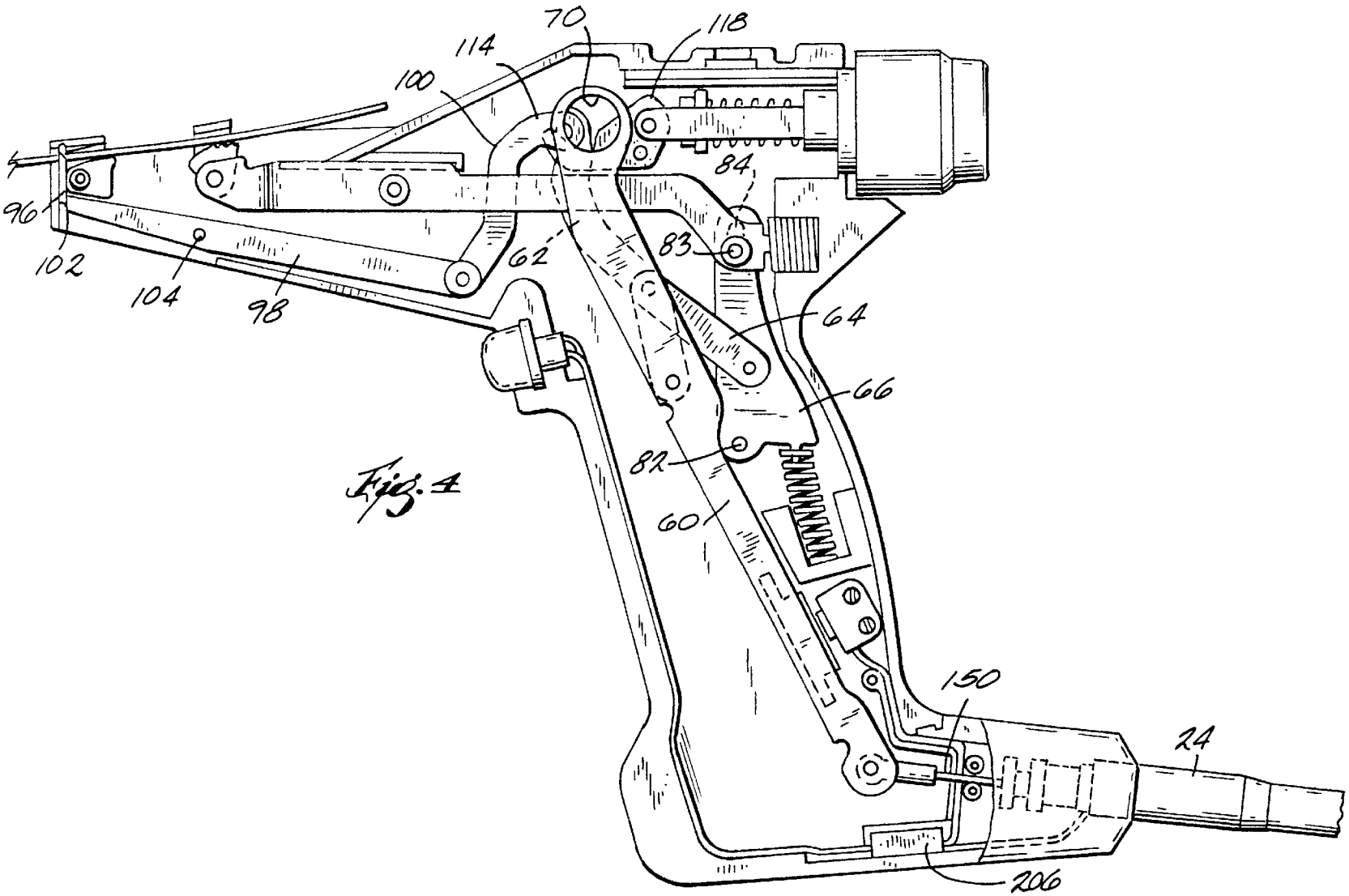
FIG. 4 is a cutaway view similar to FIGS. 2 and 3 showing the handheld unit after tension is applied to a cable tie and while the tie is being cutoff.

The operation of the handheld unit 22 can best be understood by reference to FIGS. 2–4.

FIG. 2 depicts the handheld unit 22 in its initial, unactuated state when the tie tail 18 is first inserted into the slot 50. In this condition, the trigger link 60 is fully forward and lies closely adjacent the interior front wall of the housing grip portion 30. The cutoff cam 118 is pivoted in its full clockwise position around the pivot axis 120 under a predetermined tension developed and applied by the tension control mechanism 124. This draws the pivot pin 116 into the notch and aligns the pivot pin 116, the upper ends of the actuating links 62 and the upper ends 114 of the cutoff link 100 with the pivot axis 74. The upper and lower return springs 92 and 88 pivot the handle link 66 to its full counterclockwise position around the pivot axis 82 to push the pawl links 42 forward toward the nose piece 44 and to push the trigger link 60 forward against the front interior wall of the housing grip portion 30. The tie gripping pawl 54 engages the protrusion 58 on the nose guide block 52, which pivots the pawl 54 away from the tie tail 18.

Cable tie tensioning begins when the lower end of the trigger link 60 moves toward the rear interior wall of the housing grip portion 30 to the position shown in FIG. 3. As the lower end of the trigger link 60 begins moving, the short link 64 pivots the handle link 66 in the clockwise direction around the pivot axis 82 and against the force of the lower return spring 88. The upper end of the handle link 66 draws the pawl links 42 away from the nose piece 44. The pivoting connection between the upper end of the handle link 66 and the end of the pawl links 42, together with the slot 84 formed in the upper end of the handle link 66, permit the pawl links 42 to move back in a straight line as the handle link 66 pivots. The upper return spring 92 compresses as the handle link 66 pivots and the pawl links 42 are drawn back.

As the pawl links 42 begin to move back and the pawl 54 disengages from the nose guide block 52, the pawl 54 pivots upwardly in response to its spring bias and traps the tie tail 18 between itself and the backing plate 56. This grips the tie tail 18 and pulls the tie tail 18 back along with the pawl 54 and pawl links 42. This has the further effect of pulling the tie tail 18 through the head 16 of the tie 12 to tighten the tie around the wires 14 (FIG. 1). Preferably, the upper surface of the pawl 54 is serrated to improve the grip on the tie tail 18.

When the tie 12 is initially installed and the tie tail 18 is first pulled back, it generates little resistance to being pulled. As the tie draws up against the wires 14, however, the tie tail 18 resists being pulled. This resistance is felt by the pawl links 42 and is transferred to the trigger link 60. It will be understood that the ends of the short links 64 are not connected directly to the trigger link 60 but, rather, are coupled to the trigger link 60 through the actuating links 62. For so long as the tie tail 18 does not resist being pulled by the pawl 54 and pawl links 42, little resistance is felt by the handle link 66 as it is pushed back by the short links 64. However, as the tie tail 18 begins to resist being pulled, the resistance felt by the pawl links 42 and the handle link is transferred back through the short links 64 to the actuating links 62. The resistance force thus transferred by the short links to the actuating links 62 tends to pivot the actuating links 62 in the clockwise direction around the pivot axis 76 as viewed in FIG. 3. Such pivoting movement of the actuating links 62 is prevented, however, by the pivot pin 116 that is held in position by the cutoff cam 118.

The resistance force that is transferred to the pivot pin 116 through the actuating links 62 tends to rotate the cutoff cam 118 around the pivot axis 120. The cutoff cam resists such rotation, however, because of the restraining force applied to the cutoff cam 118 by the tension control mechanism 124. When the cable tie 12 is snugged up tightly against the wires 14, the resistance to further tightening increases substantially. The increased resistance force transferred through the pawl links 42, the handle link 66, the short links 64, the actuating links 62 and the pivot pin 116 eventually becomes great enough to overcome the force applied to the cutoff cam 118 by the tension control mechanism 124. When this occurs, the cutoff cam rotates in the counterclockwise direction around the pivot axis 120 to the position shown in FIG. 4. In this position, the cutoff cam 118 has rotated forwardly thereby allowing the pivot pin 116 to move forwardly out of the notch in the cutoff cam 118. The resistance force developed by the tie tail 18 and transferred through the various links to the actuating links 62 causes the actuating links 62 to pivot in the counterclockwise direction around the pivot axis 76 under considerable force. As they do so, the actuating links 62 move the cutoff link 100, thereby causing it to push the rear end of the blade link 98 down. This pivots the blade link 98 around the pivot axis 104, thereby causing the blade link 98 to raise the blade 96 and thereby cut off the tie tail 18. When the tie tail 18 is cut, it no longer applies a resisting force to the pawl links 62, and the mechanism quickly snaps back to the condition shown in FIG. 3.

It will be appreciated that the point at which the cutoff cam rotates to actuate the blade 96 is controlled by the tension developed by the tension control mechanism 124. In this manner, the tension control mechanism 124 controls the final tension in the installed cable tie 12.

POWER ASSISTANCE

Actuating power developed in the remote power unit 20 is delivered to the handheld unit by means of the flexible cable 24. The actuating power thus delivered is used to pull the trigger link 60 from the initial position shown in FIG. 2 to the final position shown in FIG. 4.

The Flexible Cable

Figures 7A, 8:
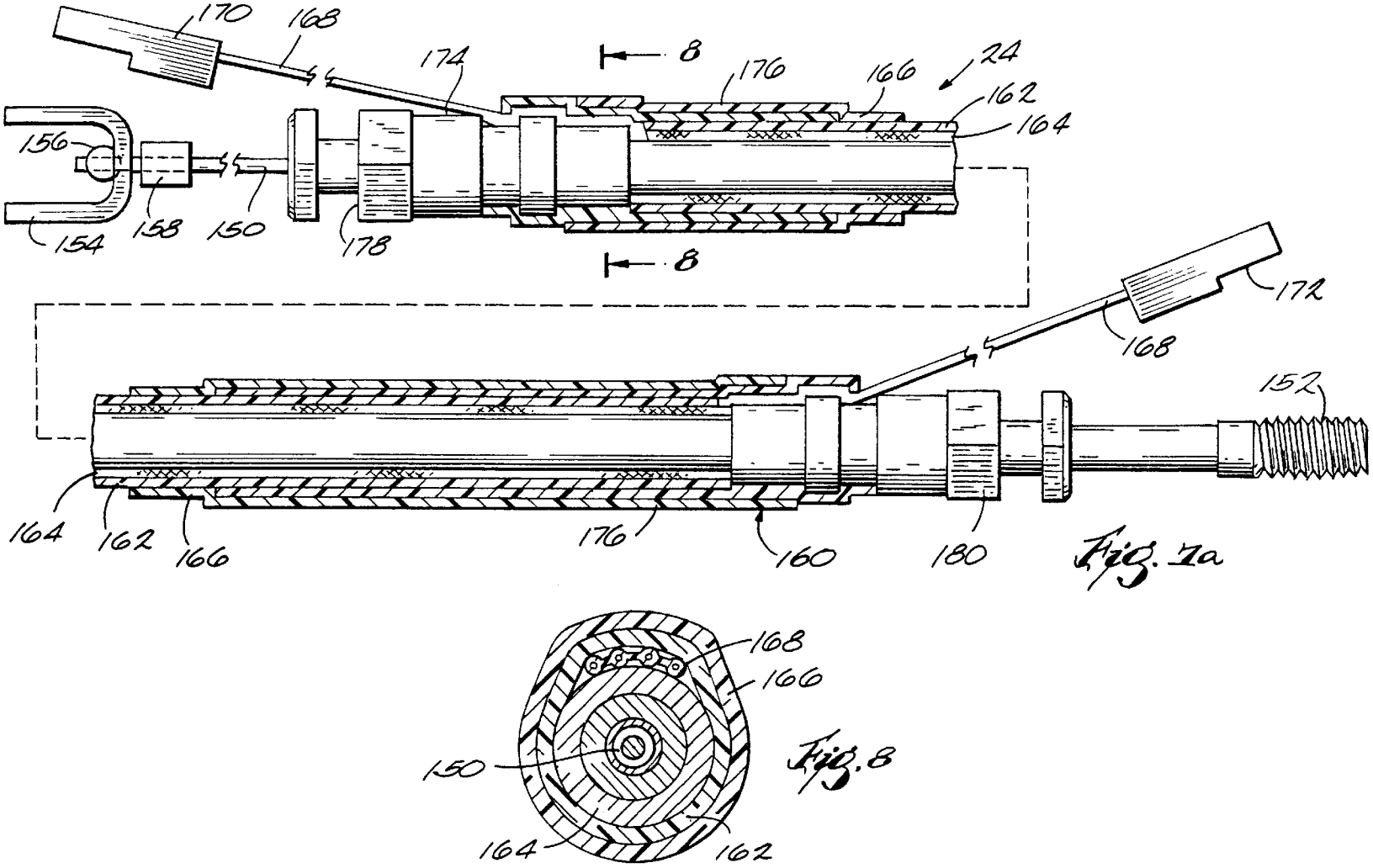
FIG. 7*a* is a side elevation view of a first embodiment of a flexible cable constructed in accordance with one aspect of the invention and embodying various features thereof.
FIG. 8 is a cross-sectional view of the flexible cable shown in FIG. 7*a* taken along line 8—8 thereof.

A preferred embodiment of the flexible cable is shown in FIGS. 7 and 8. In this embodiment, the flexible cable 24 includes a pull-cable 150 through which mechanical power is transferred to the handheld unit 22. The pull-cable 150 itself prferably comprises 1×19 prestressed stainless steel. A threaded plug 152 is attached to one end of the pull-cable 150, and a swivel bracket 154 is coupled to the other end. The swivel bracket 154 is coupled to the end of the pull-cable 150 by means of a ball 156 attached to the cable 150 immediately ahead of the bracket and a stop sleeve 158 attached to the cable immediately behind the bracket 154.

The pull-cable 150 is housed within a flexible, hollow conduit or casing 160. The casing includes a braided, metallic outer sleeve 162 surrounding a polyethylene liner 164 having a hollow interior. The pull-cable 150 extends through the hollow interior of the liner 164 and is slidably movable relative to the casing 160.

The casing 160 is contained within an expanded polyester braided sleeve 166 that surrounds the exterior of the casing 160. A plurality of electrically conductive control wires 168 extend the length of the flexible cable 24 between the exterior of the casing 160 and the outer braided sleeve 162. These wires 168 serve to communicate control signals from the handheld unit 22 to the remote power unit 20. As illustrated, the wires 168 lie substantially parallel to each other along the length of the cable 24 and project beyond the ends of the cable. Electrical connection to the wires is provided by means of a multiple pin connector 170, 172 at each end. In the illustrated embodiment, four individual control wires 168 are provided.

The end of the flexible cable 24 that joins to the handheld unit 22 terminates in a fitting 174 that is swagged or otherwise mechanically secured to the metallic braid 162. A section of heat shrinkable tubing 176 overlies the juncture between the fitting 174 and the braided metallic sleeve 162. In the illustrated embodiment, the fitting 174 includes a hexagonal outer configuration (FIG. 7*b*) and further includes an external, circular groove 178 that is used to help clamp the fitting, and, hence, the flexible cable 24, to the handheld unit 22. A similar fitting 180 is similarly attached to the opposite end of the flexible cable 24 and is used to secure the cable 24 within the remote power unit 20.

Although not critical, the cable 24 in the illustrated embodiment is approximately seven feet long.

An Alternate Cable Embodiment

Figure 9:
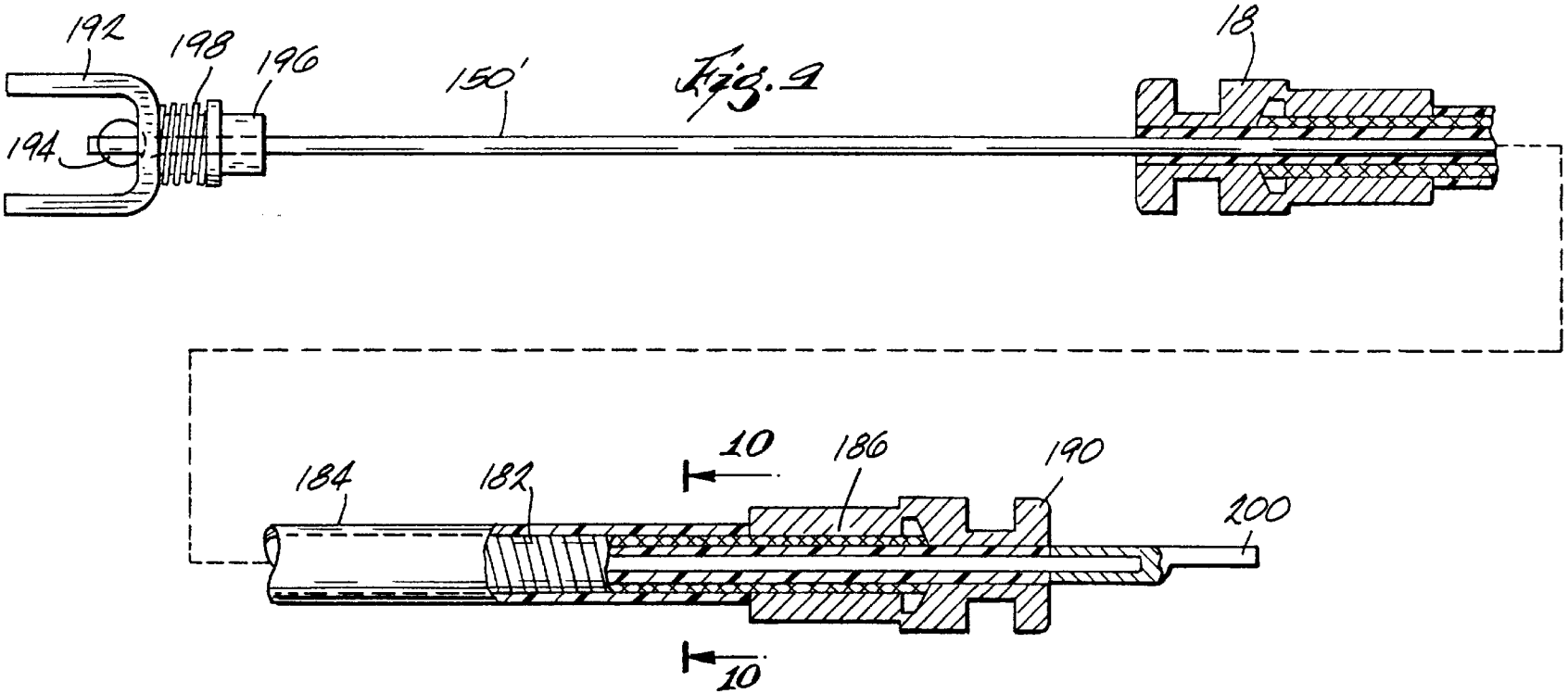
FIG. 9 is a side elevation view of an alternate embodiment of a flexible cable embodying various features of the invention.
Figure 10:
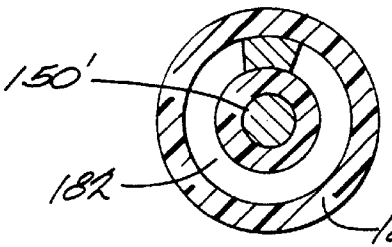
FIG. 10 is a cross-sectional view of the flexible cable shown in FIG. 9 taken along line 10—10 thereof.

An alternate embodiment of flexible cable 24' is shown in FIGS. 9 and 10. In this embodiment, the flexible cable 24' does not include the control wires and, accordingly, can be made smaller and more economically than the previously described cable 24. The alternate cable 24' is useful in an alternate embodiment of the invention (described below) wherein control signals developed in the handheld unit 22 are communicated to the remote power unit 20 through the pull-cable 150 itself rather than through separate control wires.

The alternate cable 24' includes a pull-cable 150' that is electrically conductive. In the illustrated embodiment, the pull-cable 150' preferably comprises 3/64th inch, 7×7 galvanized cable encased within an electrically insulating outer Nylon jacket. The pull-cable 150' extends through an electrically conductive, flexible outer sleeve that comprises a helically wound metallic wrap 182 contained within an electrically insulating, durable, extruded PVC jacket 184. The metallic wrap 182 is wound around a liner 186 that defines a hollow interior through which the pull-cable 150' extends. Fittings 188, 190 similar to those used in the flexible cable 24 are swagged or otherwise mechanically attached to the metallic wrap 182 to form a secure mechanical and electrical bond thereto.

A metallic swivel bracket 192 is attached to the end of the pull-cable 150' that goes to the handheld unit 22. The bracket 192 is attached by means of a conductive ball 194 swagged or otherwise attached to the metallic portion of the cable 150' and by a stop collar 196 also attached to the metallic portion of the cable 150'. A coil spring 198 between the swivel bracket 192 and the stop collar 196 biases the swivel bracket 192 up against the conductive ball 194 to help ensure a positive electrical connection between the swivel bracket 192 and the metallic portion of the pull-cable 150'. The opposite end of the pull-cable 150' terminates in an eyelet fitting 200 that is swagged or otherwise mechanically and electrically secured to the cable 150'.

Electrical energy can be communicated through the cable 24' between the pull-cable 150' and the metallic wrap 182 by establishing electrical connections to the fittings 188, 190, the swivel bracket 192 and the eyelet 200. Mechanical energy can be transmitted through the cable 24' by pulling the pull-cable 150' relative to the fitting 190.

"Power Assist" Operation

The remote power unit 20 functions broadly to pull the pull-cable 150 relative to the outer sheath 160 and thereby transfer actuating energy to the handheld unit 22. The wires 168 function broadly to communicate control signals from the handheld unit 22 to the remote power unit 20.

As illustrated in FIG. 1, one end of the flexible cable 24 extends into the remote power unit 20. The other end of the cable 24 joins the handheld unit 22 at the rear base of the grip 30. Referring to FIG. 3, the end of the flexible cable 24 adjacent the handheld unit 22 terminates in a fitting 174 that is clamped within the housing 28 by means of a clamp structure 202 that secures the cable 24 to the housing 28 and prevents movement of the outer sheath 160 relative to the housing 28. The pull-cable 150, however, remains free to move linearly relative to the housing 28.

The swivel bracket 154 at the end of the pull-cable 150 is secured within the housing 28 to the lower end of the trigger link 60. The swivel bracket 154 fits between the side walls of the trigger link 60 adjacent the lower end thereof. A pin 204 pivotally joins the bracket 162 and, thus, the pull-cable 150, to the lower end of the trigger link 60.

As best seen in FIGS. 2–4, the distance between the trigger link pivot axis 74 and the pin 204 linking the pull-cable 150 to the trigger link 60 is considerably greater than the distance between the pivot axis 74 and the pivot axis 76 linking the actuator links 62 to the trigger link 60. Accordingly, a mechanical advantage is achieved dependent upon the ratio of these lengths. This mechanical advantage is used to multiply to force applied by the pull-cable 150 to the trigger link so that the maximum tension applicable to a cable tie tail 18 is greater than the maximum tension in the pull-cable 150. Similarly, because the distance between the rear end of the blade link 98 and the blade link pivot axis 104 is greater than the distance between the blade 96 and the pivot axis 104, the upward severing force applied to the blade 96 is greater than the downward actuating force applied to the rear end of the blade link 98 by the cutoff link 100.

System Control

Actuation of the power assisted tensioning and cut-off tool system 10 is initiated by depressing the push-button 26. The push-button 26 is received in a recess formed into the grip portion 30 of the housing 28 and is electrically connected to a pair of the wires 168 in the flexible cable 24. Preferably, the push-button is connected to the wires 168 through a disengageable plug 206 that connects to the connector 170.

When the trigger link 60 has been fully pulled to the final position shown in FIGS. 3 and 4, it is necessary to signal the remote power unit 20 to relieve the tension on the pull-cable 150 and thereby allow the trigger link 60 to return to the initial position shown in FIG. 2. To this end, structure is provided for sensing when the gripping and tensioning mechanism 34 is near the final position. In the illustrated embodiment, this is achieved by means of a proximity switch 208 mounted to the rear interior wall of the housing grip portion 30. The proximity switch 208 is also coupled to a remaining pair of the wires 168 in the cable 24 through the connector 206. When the proximity switch 208 senses the nearby presence of the trigger link 60, which, in turn, signifies that the trigger link 60 and the gripping and tensioning mechanism 34 are in the final position shown in FIGS. 3 and 4, the proximity switch 208 signals the remote power unit 20 to release tension on the pull-cable 150 and thereby allow the handheld unit 22 to return to the initial position. A magnet 210 or other such actuator is preferably mounted on the trigger link 60 so as to come adjacent the proximity switch 208 when the trigger link 60 is in the final position to thereby actuate the proximity switch 208.

One advantage of using the proximity switch 208 is that the system 10 automatically compensates for any stretch that might occur in the pull-cable 150. Even if the pull-cable stretches, the remote power unit 20 will, within limits, simply pull the cable 150 until the trigger link 60 comes adjacent the limit switch 208.

"Wireless" Control

In an alternative embodiment of the invention, the handheld unit 22 communicates with the remote power unit 20 by means the "wireless" flexible cable 24' rather than through separate, dedicated control wires 156. In this embodiment, shown in FIG. 11, the control signals generated by the pushbutton 26 and the proximity switch 208 are communicated to the remote power unit 20 through the pull-cable 150' itself using various forms of existing data encoding and transfer systems.

Figure 11:
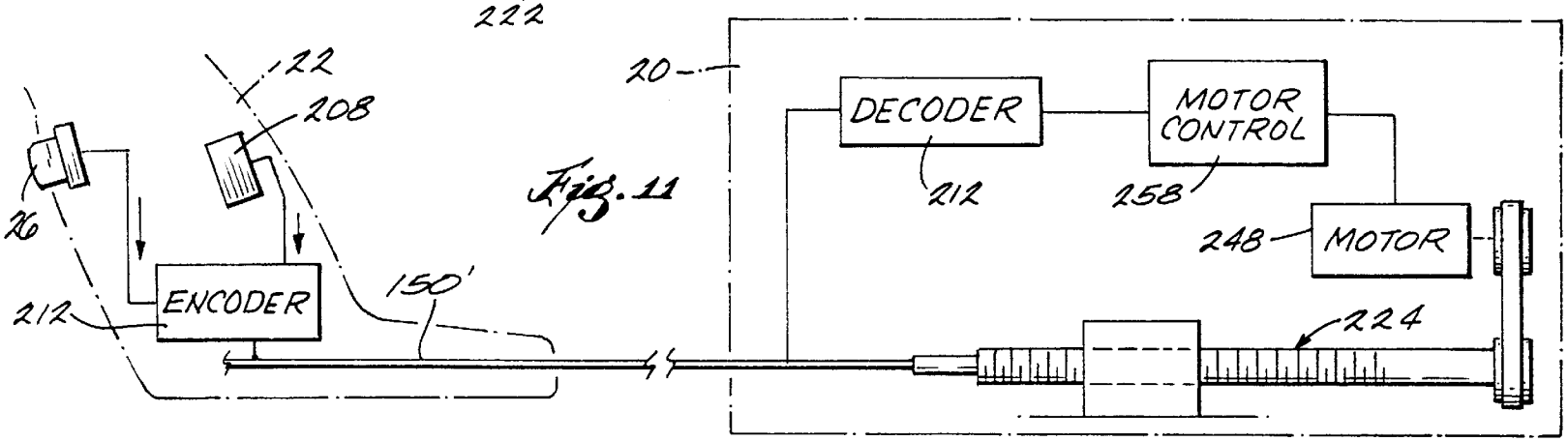
FIG. 11 is a simplified system block diagram of an alterantive embodiment wherein operating control signals are communicated between the handheld unit and the remote power unit through a pull cable.

Referring to FIG. 11, a data encoder 212 is included in the housing 28 of the handheld unit 22 and is electrically coupled to the push-button switch 26, the proximity switch 208 and the pull-cable 150'. In this embodiment, the pull-cable 150' and the outer sheath 182 are both electrically conductive and electrically insulated from each other. When either switch 26, 208 is actuated, the encoder 210 generates a coded electrical signal that is then applied between the pull-cable 150' and the sheath 182. Different codes are used to indicate actuation of the different switches 26 and 208. Electrical energy for operating the encoder 210 is transmitted up through the pull-cable 150' and the sheath 182 to the handheld unit 22 from the remote power unit 20.

In the alternative embodiment shown in FIG. 11, a data decoder 212, also of known construction, is included in the remote power unit 20. The data decoder 212 decodes the signals transmitted by the encoder 210 through the pull-cable 150' and sheath 182. The decoded signals thus obtained are thereafter used to control the operation of the remote power unit 20 in accordance with which of the switches 26 or 208 was actuated.

THE REMOTE POWER UNIT

Figure 13:
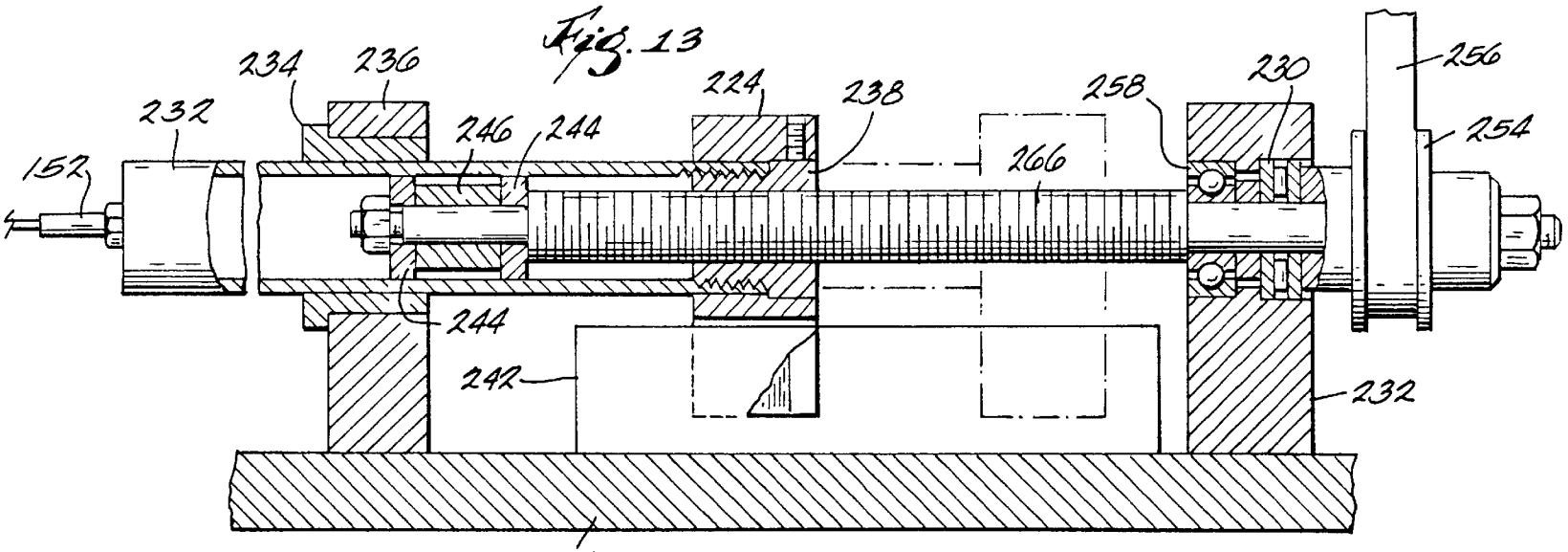
FIG. 13 is a cross-sectional view of the remote power unit shown in FIG. 12 taken along line 13—13 thereof.
Figure 12:
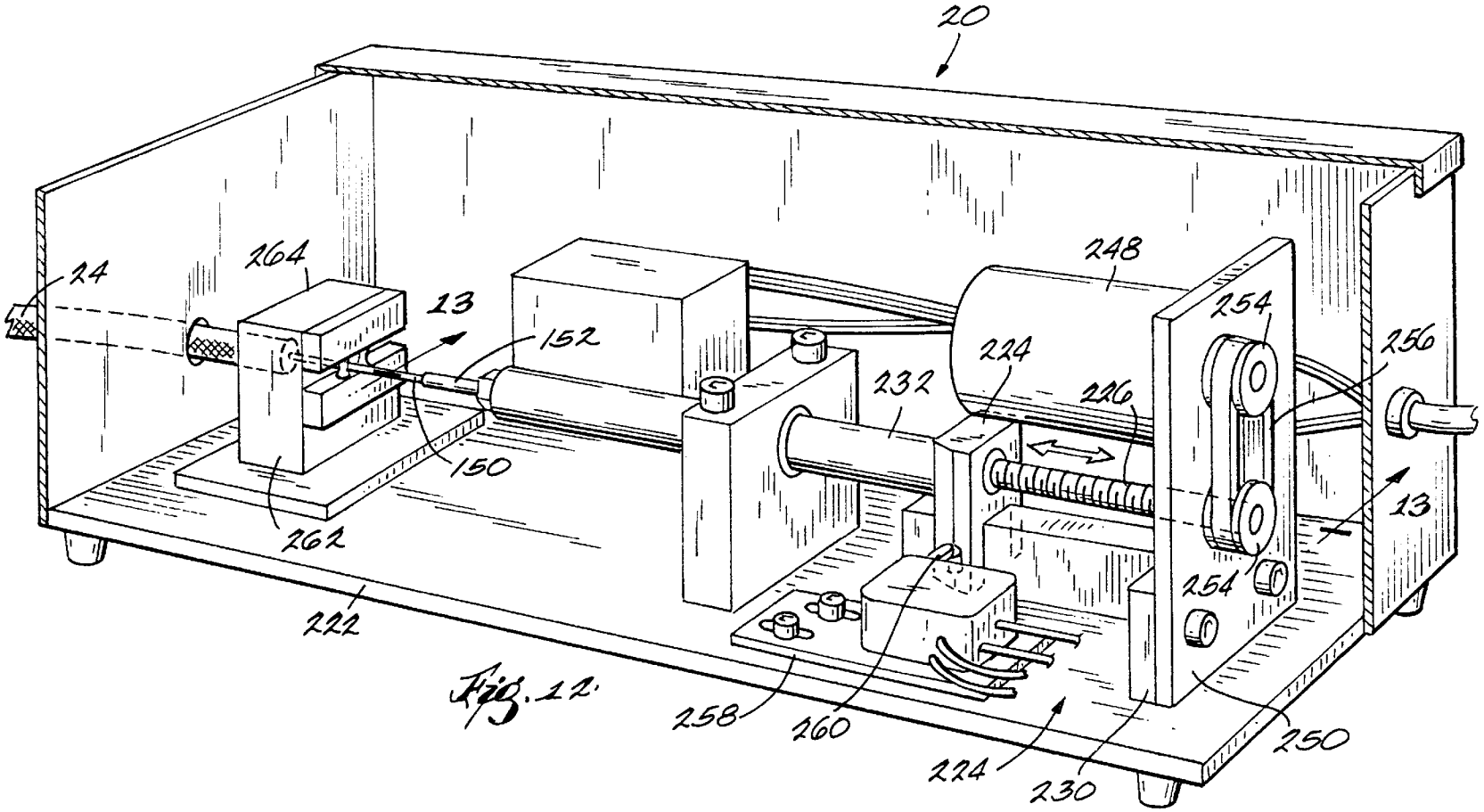
FIG. 12 is an interior perspective view of a remote power unit constructed ina accordance with one aspect of the invention and embodying various features thereof.

The internal construction of the remote power unit 20 is shown in FIGS. 12 and 13.

The remote power unit 20 is housed within a generally rectangular housing 220 and includes a lower base plate or chassis 222 on which the various internal elements are mounted. Broadly, the remote power unit includes a linear actuator assembly 224 that is coupled to the cable 24 and functions to push and pull the pull-cable 150 relative to the outer sheath 160 in response to control signals received from the push-button 26 and the proximity switch 208.

As illustrated, the linear actuator 224 includes a threaded shaft 226 that is rotatably mounted horizontally over the base 222. The rear end of the shaft 226 extends through, and is rotatably supported by, a bearing 228 that, in turn, is mounted in a rear actuator bearing block 230 mounted on, and extending vertically upwardly from the base 222. A thrust bearing 231 is provided for resisting horizontal, lateral movement of the shaft 182.

The forward end of the threaded shaft 226 is telescopingly received in one end of an elongate, horizontal actuator shaft 232 that is collinearly aligned with the threaded shaft 226 and that is supported for horizontal axial movement over the base 222. The forward end of the actuator shaft 232 is supported within a front guide bearing 234 mounted in a front actuator bearing block 236 mounted on the base 222. The front guide bearing 234 permits sliding axial movement of the actuator shaft 232 relative to the front actuator bearing block 236.

The rear end of the actuator shaft 232 is coupled to an actuator nut 238 that is threaded onto the threaded shaft 226 and that moves axially relative to the shaft 226 in response to rotation of the shaft 226. An anti-rotation collar 240 surrounds the actuator nut 238 and straddles an anti-rotation guide bar 242 that extends linearly under the threaded shaft 226 and the actuator shaft 32. The anti-rotation guide 242 bar keeps the anti-rotation collar 240, and the nut 238 coupled thereto, from rotating when the threaded shaft 226 is turned. As the threaded shaft 226 turns, the actuator nut 238 moves axially along the shaft 226, thereby causing the actuator shaft 232 to extend outwardly from, or retract inwardly into, the front guide bearing 234.

The forward end of the threaded shaft 226 is supported for rotation within the interior of the actuator shaft 232 by means of a pair of guide washers 244, formed of Delrin or other such lubricious material, mounted to the end of the threaded shaft 226 and dimensioned to fit within the actuator shaft 232. Preferably, the guide washers 244 are spaced laterally from each other and are separated by a rubber shock tube 246 that absorbs any shocks that might result if the actuator nut 238 is driven into the innermost one of the guide washers 244 as the actuator shaft 232 is returned to its initial position.

The forward end of the actuator shaft 232 is connected to the pull-cable 150. Accordingly, when the actuator shaft moves to the right as viewed in FIGS. 12 and 13, it pulls the pull-cable 150 to actuate the handheld unit 22. When the actuator shaft 232 move to the left, tension in the pull-cable 150 is released thereby allowing the handheld unit 22 to return to its initial position. The direction in which the actuator shaft 232 moves is determined by the direction in which the threaded shaft 226 turns.

The threaded shaft 226 is turned by means of an actuator motor 248 that is mounted above the threaded shaft 226 on a motor mounting plate 250 attached to the rear actuator bearing block 230. A pair of pulleys 252, 254 are attached, respectively, to the shaft of the motor 248 and to the end of the threaded shaft 226. Rotational energy is transferred from the motor 248 to the threaded shaft 226 by means of a belt 256.

The electric motor 248 can be controllably turned in either direction. An electronic control circuit 258 communicating with the push-button 26 and the proximity switch 208 through the wires 168 is provided in the remote power unit 22 for controlling operation of the motor 248 in accordance with the control signals developed by the switches 26 and 208.

When the pushbutton 26 is depressed, the control circuitry 258 drives the electric motor 248 in a first direction that turns the threaded shaft 226 so as to draw the actuator shaft 232 toward the right as viewed in FIG. 8. This pulls the pull-cable 150, thereby pulling back the trigger link 60 in the handheld unit 22.

When the proximity switch 208 senses that the trigger link 60 has been pulled fully back, the control circuit 258 reverses the motor direction, thereby driving the actuator shaft 232 in the opposite direction. This releases the tension in the pull-cable 150 and allows the trigger link 60 to return to its initial position.

Preferably, structure is provided for indicating when the actuator shaft 232 has once again returned to its initial position, To this end, in the illustrated embodiment, a limit switch 260 is mounted adjacent the anti-rotation guide 242 and closes when the anti-rotation collar 240 returns to a position adjacent the front actuator bearing block 236. Closure of the limit switch 260 signals the control circuitry 258 to stop further operation of the motor 248. Preferably, if the push-button switch 26 remains pressed when the actuator shaft 232 returns to its initial position, the whole sequence begins anew and the handheld unit 22 undergoes another cycle of operation. This avoids the need for the operator to depress the push-button 26 repeatedly in the course of installing a cable tie having a long tie tail. After inserting the tie tail into the handheld unit 22, the operator can simply depress and hold the push-button 26. The system 10 will then cycle and recycle the handheld unit 22 until the proper tie tension is achieved and the tie tail is automatically cut off.

The end of the flexible cable 24 is secured within the remote power unit 20 by means of a mounting block 262 and clamp assembly 264 mounted on the base 222 in line with the actuator shaft 232. The outer cable fitting 180 is clamped to the mounting block 262 and, hence, is immovable relative to the remote power unit 20. The threaded fitting 152 at the end of the pull-cable 150 is threaded into a threaded recess formed at the end of the actuator shaft 232. The electrical connector 172 connected to the control wires 168 is connected to a mating connector that is connected to the electronic control circuitry 258.

A HIGH TENSION EMBODIMENT

Figure 14:
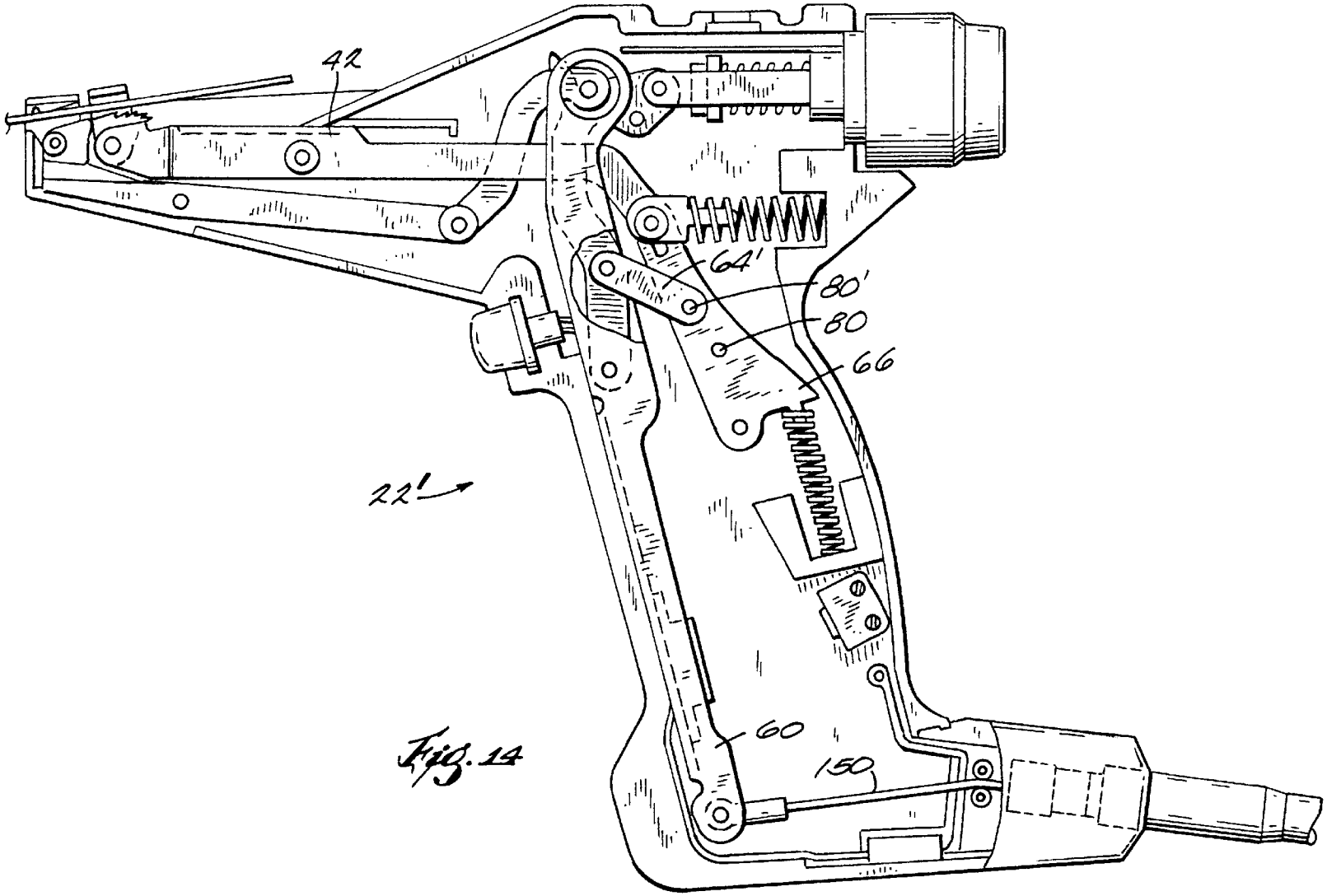
FIG. 14 is a cutaway side view, similar to FIG. 2, of an alternate embodiment handheld unit that is capable of developing higher tensions in a cable tie than can be achieved with the handheld unit of FIGS. 1–6.

A high tension embodiment of a handheld unit 22' is shown in FIG. 14. The high tension handheld unit is configured to develop greater final tensions in a cable tie than can be achieved with the handheld unit 22 shown in FIGS. 1-6.

The high tension handheld unit 22' is otherwise similar to the "standard" hand held unit 22 with the exception that the short links 64' are shorter than the short links 64 of the standard unit 22 and are coupled to the handle link 66 at a point 80' spaced farther from the handle link pivot axis 82 than in the standard unit 22. In all other respects the high tension embodiment 22' can be the same as the standard handheld unit 22.

By connecting the short links 64' to the handle link 66 at a point 80' spaced farther from the handle link pivot axis 80 than in the standard unit 22, the pawl links 42 are drawn back with greater force and tension than in the standard unit 22. This enables the high tension unit 22' to develop greater tension in the cable tie 18 given equal operating tension applied to the bottom of the trigger link 60 by the cable 150.

Preferably, to simplify manufacture and assembly, each handle link 66 is manufactured with mounting appertures formed at both the standard short link attaching position 80 and the high tension attaching position 80'. This allows a single handle link design to serve in both standard and high tension roles and avoids the need to manufacture, inventory and track seperate handle link units.

By way of illustrative example, the spacing between the standard tension attaching position 80 and the handle link pivot axis 82 in a prefered embodiment is approximately 0.592±0.005 inches, while the spacing between the high tension attaching position 80' and the handle link pivot axis 82 in a prefered embodiment is approximately 0.967±0.005 inches. This change in distance has been found to increase the resulting maximum tie tension by a factor of approximately two. It will be appreciated that these particular dimensions are provided for illustrative purposes only and that other dimensions can be used as required to achieve the goals and purposes of any particular design and use.

A LEFT-HANDED EMBODIMENT

Figure 15:
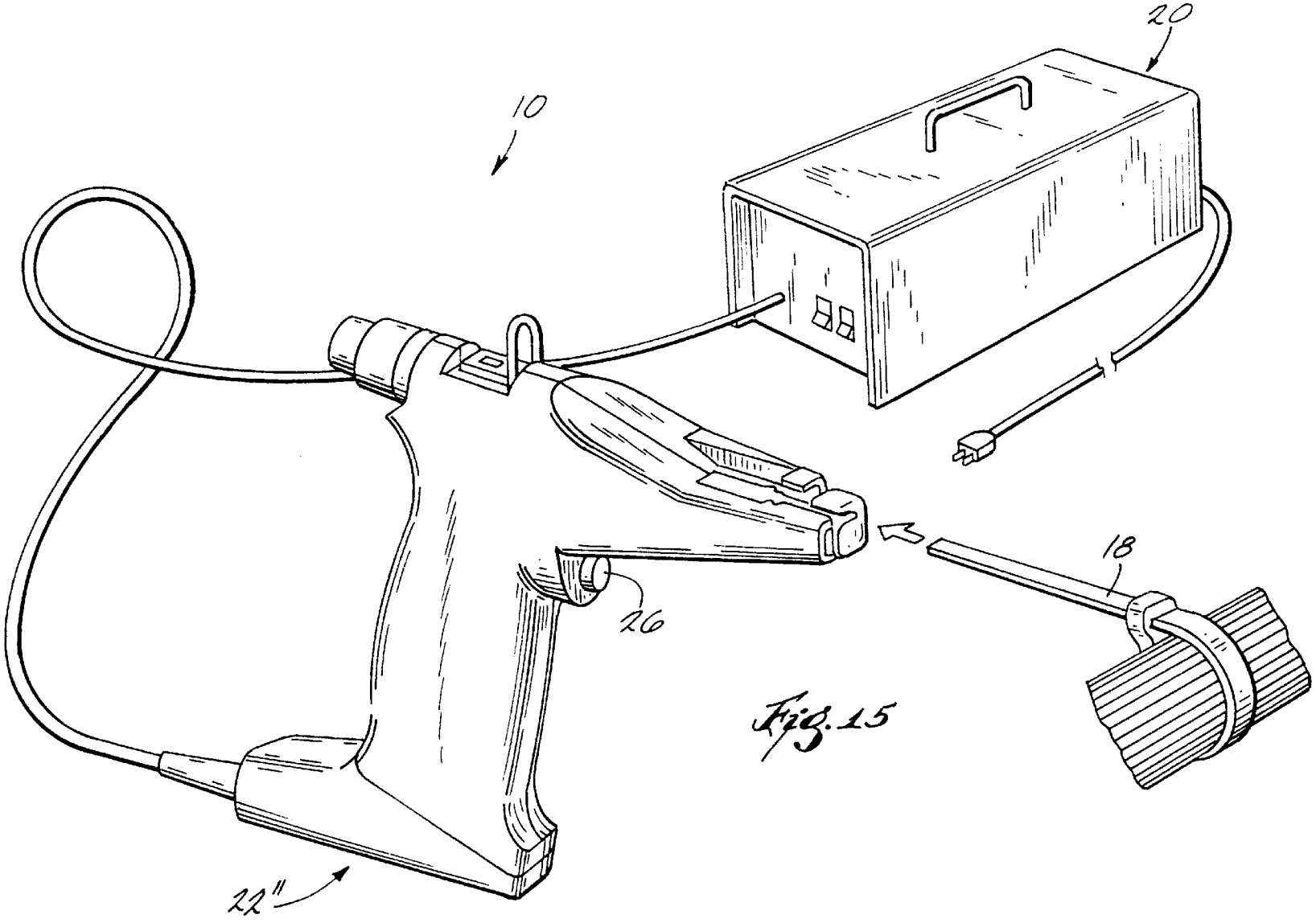
FIG. 15 is a perspective view, similar to FIG. 1, of an alternate embodiment power assisted tensioning and cutoff tool configured for left-handed operation.

The power assisted tensioning and cutoff tool system 10 can also be configured for use by left-handed operators. Such a system 10' is shown in FIG. 15.

In the left-handed system 10', the remote power unit 20 is the same as in the standard, right-handed sytem previously shown and described, and the handheld unit 22" is configured to accept cable ties 18 from the right-hand side of the tool rather than the left. This enables a left-handed tool operator to hold the handheld unit 22" in the left hand and insert the cable tie 18 into the tool 22" from the right. When the push-button trigger 26 is depressed, the tool 22" operates to tension and cutoff the tie 18 in the manner previously described.

The left-handed handheld unit 22" is identical in construction and operation to the right-handed unit 22 except for being a "mirror image" of that unit. In particular, various components of the handheld unit 22, including the pawl link 42, the housing 28, the nose piece 44, the gripping pawl 54, and the torsion spring 55 are configured in "mirror image" form in order to implement the left-handed embodiment 22". The remaining components of the handheld unit 22 are symetrical and can be used in either the standard unit 22 or the left-handed unit 22" without modification. The left-handed embodiment can also be implemented in a high tension form.

While a particular embodiment of the invention has been shown and described, it will be obvious to those skilled in the art that changes and modifications can be made without departing from the invention in its broader aspects, and, therefore, the aim in the appended claims is to cover all such changes and modifications as fall within the true spirit and scope of the invention.

We claim:

1. A power assisted tensioning and cutoff tool system comprising:

a remote power unit;

a handheld unit operable to tension a cable tie and to cutoff the excess portion of the cable tie when a predetermined tension has been achieved in the cable tie;

a power transfer member interconnecting the remote power unit with the handheld unit for transferring actuating power from the remote power unit to the handheld unit; and a user actuatable trigger for actuating the remote power unit to transfer actuating power to the handheld unit.

2. A power assisted tensioning and cutoff tool system as defined in claim 1 wherein the handheld unit comprises a pistol-like member.

3. A power assisted tensioning and cutoff tool system as defined in claim 1 wherein the power transfer member comprises an elongate flexible cable.

4. A power assisted tensioning and cut-off tool system as defined in claim 3 wherein the elongate flexible cable includes a pull-cable.

5. A power assisted tensioning and cutoff tool system as defined in claim 4 wherein the remote power unit actuates the handheld unit by pulling the pull-cable.

6. A power assisted tensioning and cutoff tool system as defined in claim 1 wherein the user-actuatable trigger comprises a push-button on the handheld unit.

7. A power assisted tensioning and cutoff tool system as defined in claim 1 wherein the remote power unit includes a linear actuator actuated in response to actuation of the pushbutton.

8. A power assisted tensioning and cutoff tool system as defined in claim 7 wherein the handheld unit includes a gripping and tensioning mechanism operable to grip and pull the tail of the cable tie to thereby tension the cable tie.

9. A power assisted tensioning and cutoff tool system as defined in claim 8 wherein the gripping and tensioning mechanism is linearly reciprocable in the handheld unit.

10. A power assisted tensioning and cutoff tool system as defined in claim 9 wherein the gripping and tensioning mechanism linearly reciprocates between an initial position and a final position and wherein the handheld unit further includes a sensor for sensing when the gripping and tensioning mechanism is near the final position.

11. A power assisted tensioning and cutoff tool system as defined in claim 10 wherein the remote unit is operable to reciprocate the gripping and tensioning mechanism from the final position to the initial position when the sensor senses that the gripping and tensioning mechanism is near the final position.

12. A power assisted tensioning and cutoff tool system as defined in claim 11 wherein the sensor and the pushbutton communicate with the remote power unit through the elongate flexible cable.

13. A power assisted tensioning and cutoff tool system as defined in claim 12 wherein the sensor and the pushbutton communicate electrically with the remote power unit and wherein the elongate flexible cable includes wires for communicating the sensor and the pushbutton with the remote power unit.

14. A power assisted tensioning and cutoff tool system as defined in claim 12 wherein the sensor and the pushbutton communicate electrically with the remote power unit and wherein the sensor and the pushbutton communicate electrically with the remote power unit through the pull-cable.

15. A power actuatable handheld tool for tensioning a cable tie and for cutting off the tie tail portion of the tensioned cable tie comprising:

a pistol-shaped housing having a handle portion and a barrel portion;

a trigger link within the handle portion movable between an initial position and a final position;

a tie gripping and tensioning mechanism in the barrel portion and coupled to the trigger link for gripping the tie tail of the cable tie and pulling the tie tail in response to movement of the trigger link from the initial position to the final position;

a cutoff mechanism coupled to the trigger link for severing the tie tail when tension in the tie tail reaches a predetermined threshold: and structure for connecting the trigger link to an external source of actuating power.

16. A power actuatable handheld tool as defined in claim 15 wherein the structure comprises a connection for attachment to the end of a linearly movable pull-cable.

17. A power actuatable handheld tool as defined in claim 16 wherein the structure further includes a clamp for securing to an outer sheath surrounding the pull-cable.

18. A power actuatable handheld tool as defined in claim 17 wherein the trigger link comprises an elongate member having an upper end pivotably coupled to the barrel portion of the housing and a lower end adjacent the lower end of the handle portion.

19. A power actuatable handheld tool as defined in claim 18 wherein the connection pivotally joins the end of the pull-cable to the lower end of the trigger link.

20. A power actuatable handheld tool as defined in claim 19 wherein the clamp is located adjacent the lower end of the handle portion.

21. A power actuatable handheld tool as defined in claim 15 further comprising a user-actuatable input for controllably actuating the handheld tool.

22. A power actuatable handheld tool as defined in claim 21 wherein the user-actuatable input comprises a push button.

23. A power actuatable handheld tool as defined in claim 22 further comprising a first communications link for communicating the push button with the external source of actuating power.

24. A power actuatable handheld tool as defined in claim 23 wherein the first communications link communicates electrically with the external source of actuating power.

25. A power actuatable handheld tool as defined in claim 24 further comprising a sensor for sensing when the trigger link is adjacent the final position.

26. A power actuatable handheld tool as defined in claim 25 further comprising a second communications link for communicating the sensor with the external source of actuating power.

27. A power actuatable handheld tool as defined in claim 26 wherein the second communications link communicates electrically with the external source of actuating power.

28. A power actuatable handheld tool as defined in claim 27 wherein the first and second communications links comprise a plurality of wires coupled between the push button and the external source of actuating power and between the sensor and the source of actuating power.

29. A power actuatable handheld tool as defined in claim 27 wherein actuating power is delivered to the trigger link by means of a pull-cable and wherein the first and second communications links transmit control signals along the pull-cable.

30. A remote power unit for supplying actuating power to a handheld tool operable to tension a cable tie and to sever the tie tail of the tensioned cable tie comprising:

a linear actuator;

a pull-cable coupled to the linear actuator; and a control system responsive to first and second control signals developed by the handheld tool, the control system being operable to actuate the linear actuator to pull the pull-cable from an initial position to a final position in response to receipt of the first control signal and to return the pull-cable from the final position to the initial position in response to receipt of the second control signal.

31. A remote power unit as defined in claim 30 wherein the control system includes a plurality of conductors for communicating the first and second control signals from the handheld tool to the remote power unit.

32. A remote power unit as defined in claim 31 wherein the plurality of conductors and the pull-cable are together housed within a single flexible sheath.

33. A remote power unit as defined in claim 30 wherein the control system receives the first and second control signals from the handheld tool through the pull-cable.

34. A remote power unit as defined in claim 30 wherein the linear actuator includes a threaded shaft and a nut assembly linearly movable along the threaded shaft in response to rotation of the threaded shaft.

35. A remote power unit as defined in claim 34 wherein the pull-cable is coupled to the nut assembly and the rotatable shaft is turned by means of an electric motor.

36. A remote power unit as defined in claim 35 wherein the control system is operable to turn the electric motor in either direction to thereby move the nut assembly in either direction along the threaded shaft and thereby move the pull-cable between the initial and final positions.

37. A remote power unit as defined in claim 36 wherein the control system operates to turn the electric motor in a first direction in response to the first control signal and to turn the electric motor in the opposite direction in response to the second control signal.

38. A remote power unit as defined in claim 37 wherein the control system includes a limit switch that is actuated by the nut assembly when the pull-cable is in the initial position.

39. A remote power unit as defined in claim 37 wherein actuation of the limit switch signals the control system to stop turning the electric motor in the opposite direction.

40. A power actuatable handheld tool for tensioning a cable tie and for cutting off the tie tail portion of the tensioned cable tie comprising:

a pistol-shaped housing having a handle portion and a barrel portion;

a trigger link within the handle portion movable between an initial position and a final position;

a tie gripping and tensioning mechanism in the barrel portion and coupled to the trigger link for gripping the tie tail of the cable tie and pulling the tie tail in response to movement of the trigger link from the initial position to the final position;

a cutoff mechanism coupled to the trigger link for severing the tie tail when tension in the tie tail reaches a predetermined threshold;

a pull-cable connected to the trigger link and operable to pull the trigger link from the initial position to the final position; and a return mechanism for returning the trigger link from the final position to the initial position when the pull-cable ceases pulling the trigger link toward the final position.

41. A power actuatable handheld tool as defined in claim 40 wherein the cutoff mechanism includes a cutoff cam and wherein the trigger link is coupled to the cutoff mechanism through an actuating link having one end coupled to the trigger link and another end coupled to the cutoff cam.

42. A power actuatable handheld tool as defined in claim 41 wherein the trigger link is coupled to the tie gripping and tensioning mechanism through a short link having one end coupled to the actuating link and another end coupled to the tie gripping and tensioning member.

43. A power actuatable handheld tool as defined in claim 42 wherein the other end of the short link is coupled to the tie gripping and tensioning member through a handle link.

44. A power actuatable handheld tool as defined in claim 43 wherein the return mechanism comprises a return spring engaging the handle link.

45. A power actuatable handheld tool as defined in claim 44 wherein the short link, the handle link and the return spring are all disposed within the handle portion.

46. A power actuatable handheld tool as defined in claim 45 wherein one end of the handle link is pivotally coupled to the housing, the other end of the handle link is coupled to the tie gripping and tensioning member and the short link is pivotally coupled to the handle link between the ends of the handle link.

47. A power actuatable handheld tool as defined in claim 46 wherein the handle portion includes a front side and a backside and wherein the trigger link extends within the handle portion for pivotable movement from the initial position along the front side of the handle portion to the final position adjacent the backside of the handle portion.

48. A power actuatable handheld tool as defined in claim 47 wherein the trigger link includes a lower end and the pull-cable is coupled to the lower end of the trigger link.

49. A power actuatable handheld tool as defined in claim 48 wherein the handheld tool further includes a pushbutton actuating switch extending forwardly from the front side of the handle portion.

50. A power actuatable handheld tool as defined in claim 49 wherein the handheld tool further includes a proximity switch within the handle portion adjacent the backside of the handle portion for sensing when the trigger link is in the final position adjacent the backside of the handel portion.

51. A power actuatable handheld tool as defined in claim 50 wherein the pull-cable is enclosed within an outer sheath and the handheld tool further includes structure for securing the outer sheath to the handle portion.

52. A power actuatable handheld tool as defined in claim 51 wherein the structure is disposed adjacent the lowermost end of the handle portion.

* * * * *